US006827673B2

(12) United States Patent
Chen et al.

(10) Patent No.: US 6,827,673 B2
(45) Date of Patent: Dec. 7, 2004

(54) COLLAPSIBLE POGO STICK

(75) Inventors: Robert Chen, Cerritos, CA (US); Pinchieh Feng, Chang Hua Sheng (TW); Robert A. Hadley, Yorba Linda, CA (US)

(73) Assignee: Razor USA LLC, Cerritos, CA (US)

( * ) Notice: Subject to any disclaimer, the term of this patent is extended or adjusted under 35 U.S.C. 154(b) by 403 days.

(21) Appl. No.: 09/887,553

(22) Filed: Jun. 22, 2001

(65) Prior Publication Data

US 2002/0160888 A1 Oct. 31, 2002

Related U.S. Application Data

(60) Provisional application No. 60/287,123, filed on Apr. 27, 2001.

(51) Int. Cl.[7] ..... A63B 25/08; A63B 21/008

(52) U.S. Cl. ..... 482/77; 482/112

(58) Field of Search ..... 482/77, 112–113, 482/73–76; 280/87.05

(56) References Cited

U.S. PATENT DOCUMENTS

| | | | | |
|---|---|---|---|---|
| 2,510,509 A | | 6/1950 | Mays | |
| 2,865,633 A | | 12/1958 | Woodall | |
| 2,871,016 A | | 1/1959 | Rapaport | |
| 2,929,459 A | | 3/1960 | Spitzmesser | |
| 3,351,342 A | | 11/1967 | Guin | |
| 3,773,320 A | | 11/1973 | Samiran et al. | |
| 3,782,352 A | * | 1/1974 | Sparber | 239/533.1 |
| 3,853,195 A | * | 12/1974 | Rasanen | 180/8.1 |
| D263,485 S | | 3/1982 | Rudell et al. | |
| 4,390,178 A | | 6/1983 | Rudell et al. | |
| 4,632,371 A | | 12/1986 | Wirges et al. | |
| 5,087,037 A | | 2/1992 | Morrow | |
| 5,102,119 A | | 4/1992 | Gerlach | |
| 5,713,819 A | | 2/1998 | Hsieh | |
| 5,921,899 A | | 7/1999 | Rose | |
| 6,173,976 B1 | * | 1/2001 | Lee | 280/87.05 |
| 6,301,749 B1 | * | 10/2001 | Chen | 16/429 |
| 6,428,021 B1 | * | 8/2002 | Tung | 280/87.041 |
| 6,503,177 B2 | * | 1/2003 | Herman | 482/77 |
| 6,558,265 B1 | * | 5/2003 | Middleton | 472/135 |

FOREIGN PATENT DOCUMENTS

WO WO 9961111 A1 * 12/1999 ..... A63B/25/08

* cited by examiner

*Primary Examiner*—Nicholas D. Lucchesi
*Assistant Examiner*—Fenn Mathew
(74) *Attorney, Agent, or Firm*—Knobbe Martens Olson & Bear LLP

(57) ABSTRACT

A pogo stick comprising a handlebar, a grip portion, and a footrest that is collapsible into a small volume for easy transportation and compact storage. The handlebar is provided with at least one elongate telescoping member, the grip portion is provided with removable grips, and the footrest is provided with pivotally mounted plates. The collapsible pogo stick incorporates a pneumatic spring of variable stiffness for accommodating users of different body weights. The pneumatic spring includes a pressure cylinder and a shaft extending out of the cylinder for engagement with the ground. The pneumatic spring includes a self-charging mechanism such that the cylinder may be charged without the use of an external pump.

13 Claims, 14 Drawing Sheets

COLLAPSIBLE POGO STICK

RELATED APPLICATIONS

The present application claims priority under 35 U.S.C. §119(e) to U.S. Provisional Application No. 60/287,123, filed Apr. 27, 2001.

FIELD OF THE INVENTION

The present invention relates generally to an amusement device, and more particularly to a pogo stick that is collapsible for compact storage and is adjustable for use by persons of various heights and weights.

BACKGROUND OF THE INVENTION

Pogo sticks are amusement devices that have been known in the art for many years and provide fun and exercise, particularly among children and adolescents. An exemplary pogo stick of the type known in the art is illustrated in FIG. 1. The pogo stick 1 comprises a frame 2, a footrest 3, a pair of handgrips 7, a shaft 6 slidably coupled to the frame 2, and a mechanical spring 5. The spring 5 fits over the shaft 6 such that the bottom end of the spring 5 is coupled to the shaft 6 and the top end of the spring 5 is coupled to the frame 2 via a cross-member 8. A rubber pad 4 is provided at the base of the shaft 6. The user stands on the footrest 3 and holds the handgrips 7 while performing a vertical jumping motion in conjunction with the spring forces provided by the spring 5. When the rubber pad 4 impacts the ground, the shaft 6 is forced upward into the frame 2 thereby compressing the spring 5. The spring 5 then resiliently recoils to thrust the shaft 6 back downward from the frame 2 and propel the user upward into the air.

Pogo sticks known in the art are manufactured with a rigid unitary body whereby the grips and footrest are permanently attached to the frame through welding or other means. Due to their unitary structure, pogo sticks cannot be collapsed and therefore require a large amount of storage space and are cumbersome to transport.

Pogo sticks known in the art use a mechanical spring having a fixed stiffness. The fixed stiffness significantly limits the efficiency and enjoyment of the pogo stick for users whose body weight is not compatible with the particular stiffness of the spring. A mechanical spring can also undergo gradual softening as it is subjected to working cycles, thereby causing the pogo stick to become completely inoperable over time. A mechanical spring also gives rise to undesirable frictional forces that detract from the efficiency and enjoyment of the pogo stick. Furthermore, mechanical springs are typically manufactured from steel that can rust and corrode when exposed to moisture. Worse yet, mechanical springs are subject to fatigue failures, which can result in a serious injury to the user.

Pneumatic springs are known in the art and generally comprise a pressure cylinder filled with a gas and a piston that is axially contained within the cylinder. Over the years, various designs have been proposed for substituting a pneumatic spring into a pogo stick. However, the pneumatic spring pogo sticks that have been proposed heretofore are complex devices that involve a large number of components. The complexity of these pogo sticks has made them prohibitively expensive to manufacture and prone to mechanical failures. Furthermore, although some of the proposed pneumatic spring pogo sticks were intended to be adjustable to accommodate users of various weights, none of the proposed pneumatic springs provides a practical means for adjusting the spring stiffness.

SUMMARY OF THE INVENTION

The preferred embodiments of the present invention provide a substantially improved pogo stick that is collapsible into a small volume for easy transportation and compact storage while having a rugged construction that ensures high quality and durability. The preferred embodiments are also provided with an improved pneumatic spring of variable stiffness. Another feature of the preferred embodiments is the minimization of frictional forces in the spring mechanism to provide a very smooth and enhanced jumping motion. The preferred embodiments are adapted to be made of a lightweight material that is resistant to corrosion.

A significant feature of the pogo sticks constructed in accordance with the preferred embodiments of this invention is the ease of transportability. Because it can be collapsed into a small volume, the pogo stick can be easily carried in a backpack or by hand to virtually any location. This feature facilitates sharing the pogo stick with others and joining with other pogo stick users in simultaneous use.

In one aspect of the present invention, a collapsible pogo stick is provided generally comprising a handlebar, a grip portion, a footrest, and a pneumatic spring. The handlebar comprises two substantially parallel elongate members wherein each elongate member comprises an upper tube and a lower tube. The upper tubes are telescopically adjustable with respect to the lower tubes for accommodating users of different heights. Furthermore, the upper tubes can be completely inserted into the lower tubes to reduce the height of the pogo stick when not in use. The footrest is transversely mounted at the bottom end of the handlebar and comprises a middle platform section and two plates that are pivotally mounted to each side of the platform. The plates can be folded upward to reduce the width of the pogo stick when not in use.

In another aspect of the present invention, a short middle tube is transversely mounted at the top of the handlebar and two grips are detachably coupled to the ends of the middle tube. An elastic cord extends through the middle tube and connects the grips to prevent the grips from becoming separated from the middle tube.

In another aspect of the present invention, a pneumatic spring is mounted at the bottom end of the handlebar and comprises a hollow pressure cylinder filled with a gas and a piston that is axially movable within the cavity of the cylinder. A shaft is coupled to the piston and extends downward out of the pneumatic cylinder for engagement with the ground. A significant feature of the preferred embodiments of this invention is the ability to vary the mass of the gas in the cylinder to adjust the stiffness of the pneumatic spring. Another feature of this preferred embodiment is the minimization of frictional forces in the spring mechanism.

In another aspect of the present invention, the cylinder of the pneumatic spring is mounted at the bottom end of the handlebar between the lower tubes. In one embodiment, a fastening ring is coupled to the top end of the cylinder and extends around each of the lower tubes to securely attach the pressure cylinder to the handlebar.

In another aspect of the present invention, the elongate members are rigid members that are slidably engaged within brackets on the outer portion of the cylinder. The handlebar may be raised and lowered with respect to the cylinder by sliding the elongate members through the brackets.

In another aspect of the present invention, the middle platform of the footrest is provided with a threaded through hole for engagement with a threaded region on the lower exterior portion of the cylinder to further secure the pressure cylinder to the handlebar.

In another aspect of the present invention, the shaft of the pneumatic spring is formed with a hollow interior portion and a manual pump is provided in the interior portion of the shaft. The manual pump provides a self-charging mechanism for increasing the stiffness of the pneumatic spring. The pump mechanism comprises a pumping piston that is slidably contained within the interior of the shaft and a pumping rod coupled to the pumping piston which provides a means to move the piston. Because the pump is substantially self-contained within the shaft, the internal pump mechanism does not affect the size of the pneumatic spring.

In another aspect of the present invention, a manual pump is provided on top of the cylinder for increasing the mass of gas in the cylinder. The manual pump includes a pump handle that is used for reciprocal actuation of the pump piston to increase the mass of gas in the cylinder.

In another aspect of the present invention, the collapsible pogo stick is provided with a handlebar comprising only a single elongate member having a lower tube and an upper tube. The bottom end of the lower tube is mounted to the top end of the pressure cylinder. The upper tube telescopes into the lower tube to accommodate users of various heights and to reduce the size of the pogo stick when not in use. In one variation of this aspect, the telescoping elongate member is operatively connected to a pump mechanism on the cylinder. The upper tube is telescoped in and out of the lower tube to actuate the pump and increase the mass of gas in the cylinder.

In another aspect of the present invention, a buffer sleeve of an elastic material is provided at the bottom end of the shaft for improved traction and to cushion the impact while jumping. The buffer sleeve may also serve to protect a self-charging pump mechanism contained within the shaft of the pneumatic spring.

In another aspect of the present invention, the mass of gas in the cylinder can be adjusted using a two-way valve mounted on the cylinder. The two-way valve can be attached to a pressurized source of gas or an external manual pump. The two-way valve also provides a means to rapidly discharge the gas from the cylinder.

In another aspect of the present invention, the piston can be fully advanced into the interior of the cylinder by completely discharging the gas from the cylinder. This aspect further reduces the size of the pogo stick when not in use.

DETAILED DESCRIPTION OF THE INVENTION

Figure 1:
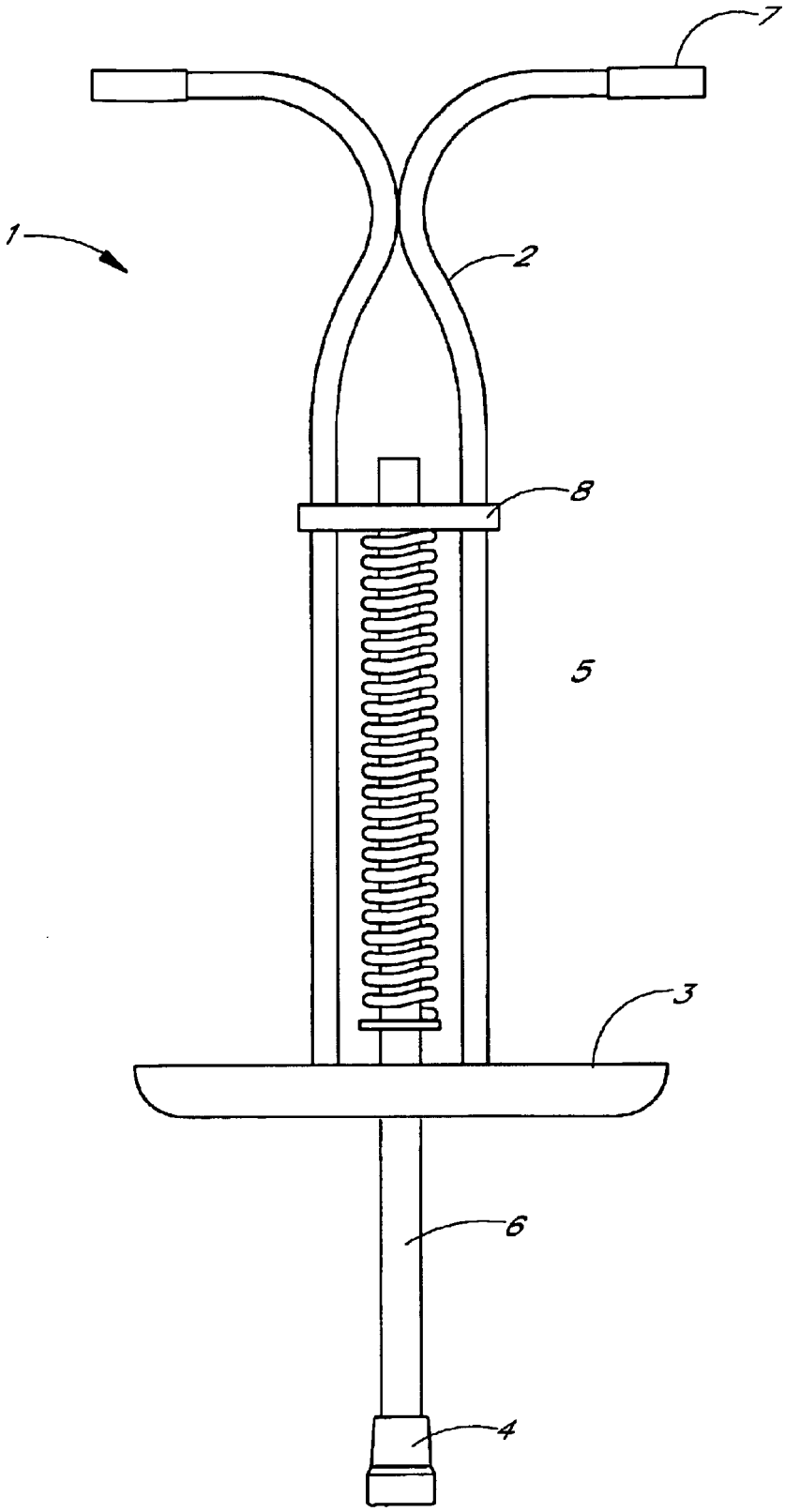
FIG. 1 shows a perspective view of a pogo stick of the type known in the art.

FIGS. 2–5 illustrate a preferred embodiment of a collapsible pogo stick 10 in accordance with the present invention. The pogo stick 10 includes, generally, a handlebar 20, a grip portion 26, a footrest 30, a pneumatic cylinder 40 and a shaft 41 extending from the pneumatic cylinder. The handlebar 20 is formed of two parallel elongate members 22 wherein each elongate member comprises a lower tube 23 and an upper tube 24 which telescopically slides into the lower tube 23. A positioning device 25 is provided at the top end of the lower tube 23 for fixing the position of the upper tube 24 relative to the lower tube 23. The position of the upper tube 24 is adjustable to accommodate users of different heights or to reduce the size of the pogo stick 10 for easy transportation or compact storage.

Figure 3:
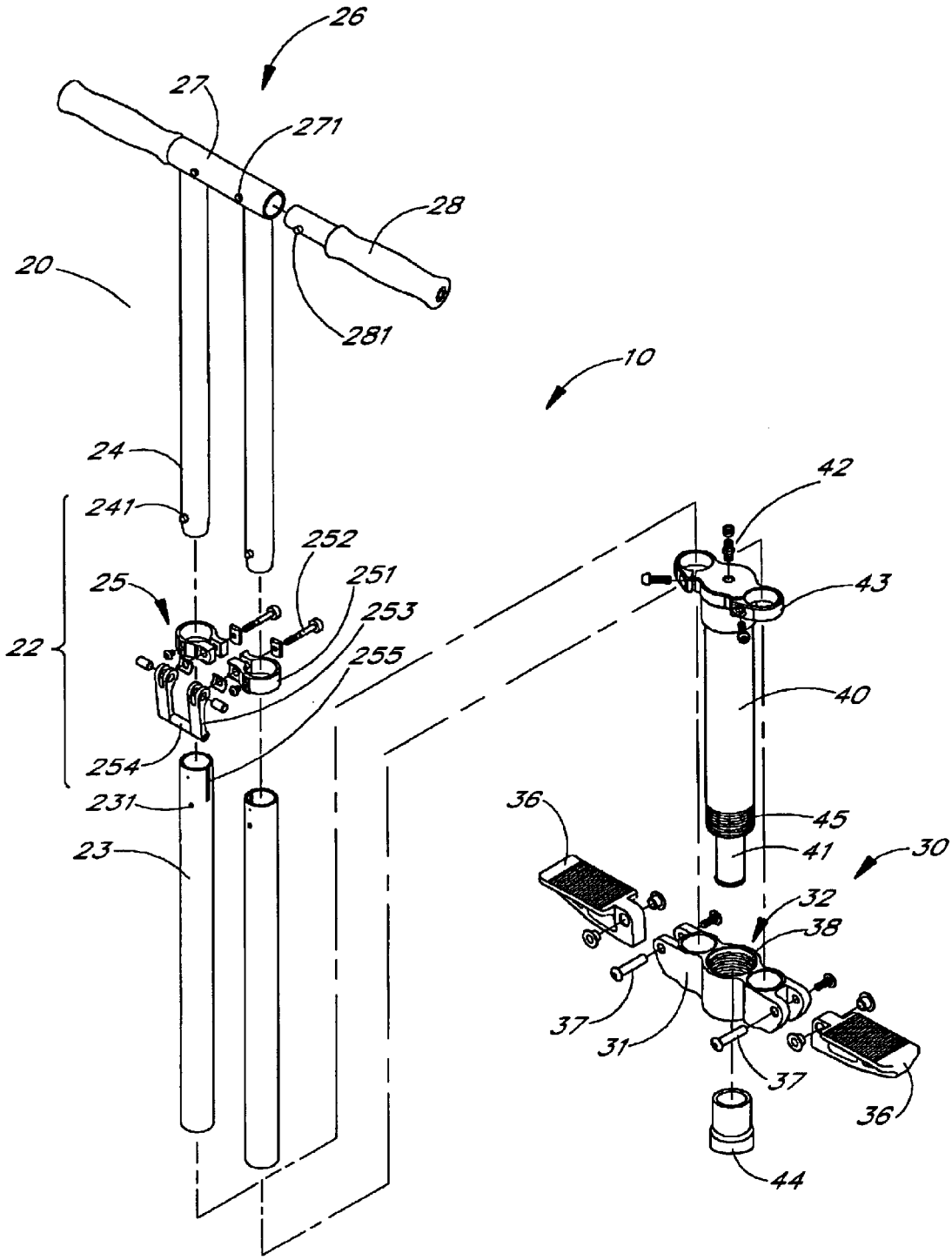
FIG. 3 shows an exploded view of the collapsible pogo stick of FIG. 2.

As illustrated in FIG. 3, the positioning device 25 comprises clamping rings 251 and shaft rods 252 which are inserted through the clamping rings 251. Cam arms 253 are coupled to the shaft rods 252 and are linked at the free end with a connection arm 254. As the cam arm 253 is rotated downward, the shaft rod 252 is pulled outward thereby reducing the diameter of the clamping ring 251. The lower tube 23 is provided at the top end with a longitudinal slot 255 such that the diameter of the lower tube 23 is reduced as the clamping ring 251 is tightened. When the diameter of the lower tube 23 is reduced, the upper tube 24 cannot telescopically slide within the lower tube 23 and therefore the position of the upper tube 24 is fixed.

Each upper tube 24 is provided at the bottom end with a retaining projection 241 which is retained in a retaining hole 231 when in the fully extended position for preventing the upper tube 24 from inadvertently sliding out of the lower tube 23. Additional retaining holes (not shown) may also be provided in addition to or as a substitute for the positioning device 25 for maintaining the upper tube 24 and the lower tube 23 at a variety of relative positions.

Figure 4:
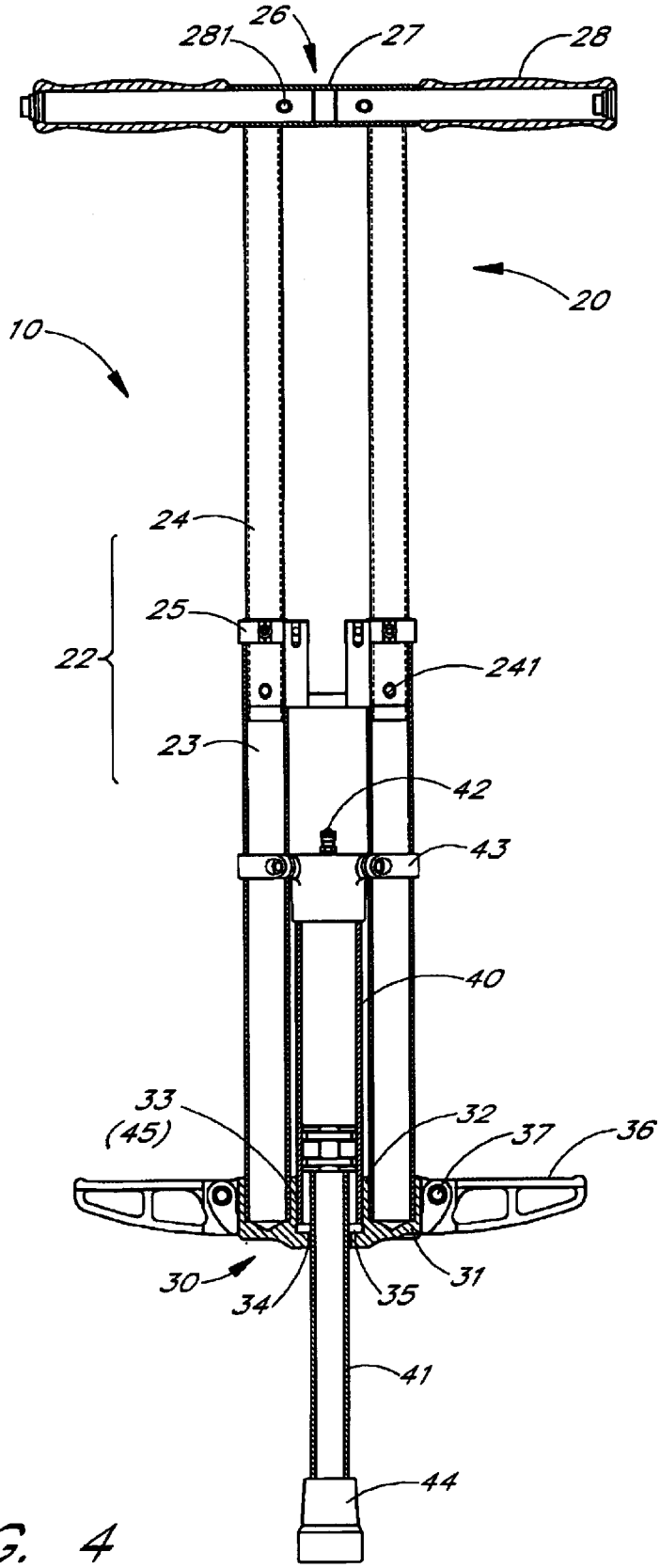
FIG. 4 shows a sectional view of the collapsible pogo stick of FIG. 2.
Figure 5:
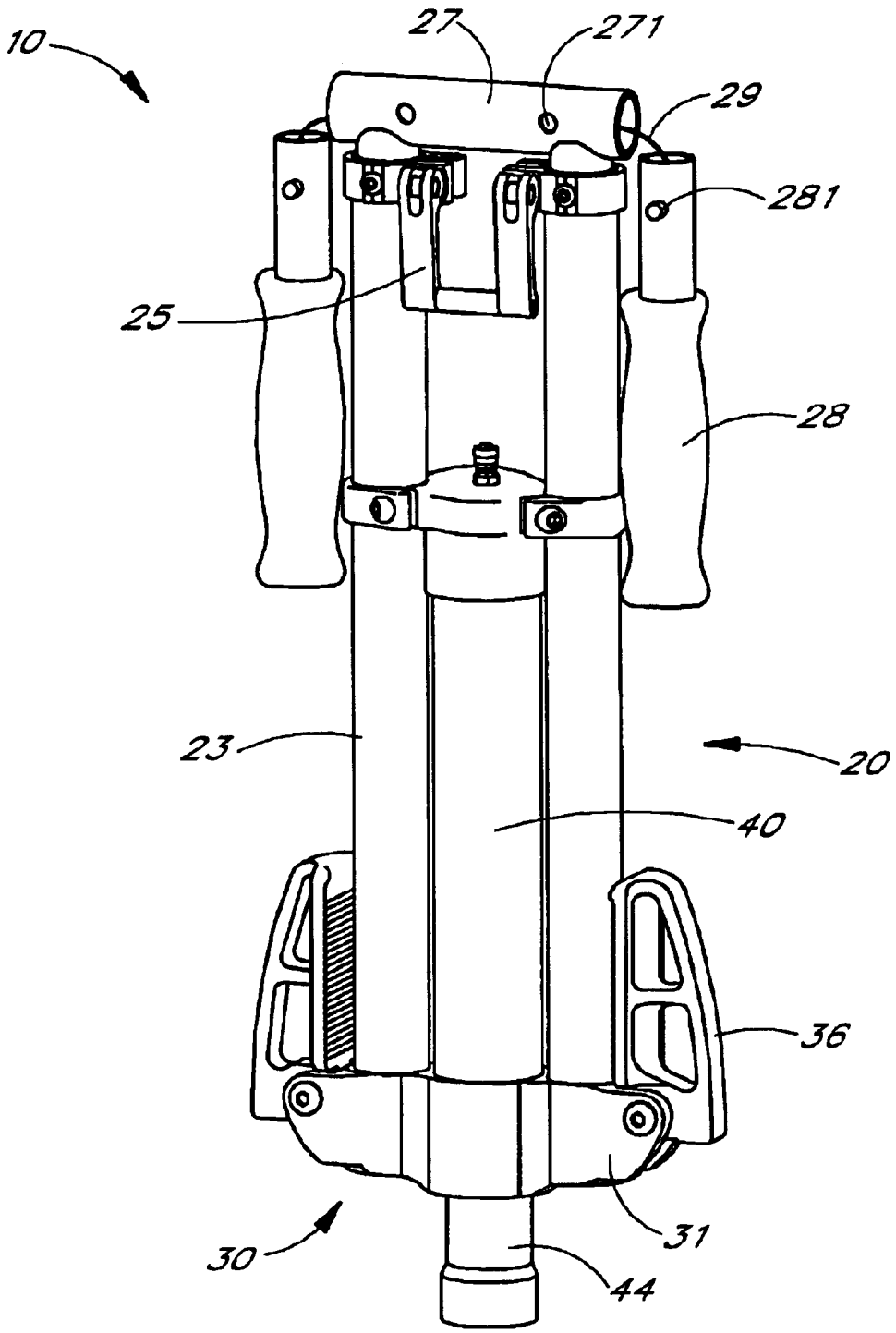
FIG. 5 shows a perspective view of the collapsible pogo stick of FIG. 2 in the collapsed state.

Still referring to FIGS. 2–5, the grip portion 26 comprises a middle tube 27 transversely mounted at the top ends of the upper tubes 24 and first and second grips 28 that telescopically fit into the two ends of the middle tube 27. Each grip 28 is provided with a retaining projection 281 for use in detachably fastening the grip 28 to the middle tube 27 by cooperation with a retaining hole 271. As illustrated in FIG. 5, the two grips 28 are preferably connected by an elastic cord 29 to prevent them from becoming separated from the middle tube 27 when in the detached condition.

Still referring to FIGS. 2–5, the footrest 30 comprises a middle platform 31 located at the bottom end of the lower tubes 23 and two plates 36 pivotally mounted to the platform 31 by means of two pivot pins 37. The two plates 36 can be folded upward in relation to the platform 31 by pivoting the plates 36 about the pivot pins 37. The platform 31 is provided at the center with a through hole 32 having a large diametrical portion 33, a small diametrical portion 34, and a shoulder 35 located between the large diametrical portion 33 and the small diametrical portion 34. The large diametrical portion 33 is provided with threads 38 on the internal edge.

The pneumatic cylinder 40 is supported at the bottom end of the handlebar 20. The cylinder 40 is provided at the top end with a two-way valve 42 formed with a threaded valve stem. An extension (not shown) may be attached to the two-way valve stem to facilitate depressing the pin located at the center of the valve stem. The cylinder 40 is preferably attached at the top end to the two lower tubes 23 by fastening rings 43. The cylinder 40 is provided at the bottom end with outer threads 45 formed for engagement with the threads 38 of the threaded diametrical portion 33 of the platform 31. The shaft 41 extends out of the cylinder 40 and passes through the small diametrical portion 34. The shaft 41 is provided at the bottom end with a buffer sleeve 44 of a rubber material for engagement with the ground. The buffer sleeve 44 cushions the impact during use and protects the free end of the shaft 41.

Figure 2:
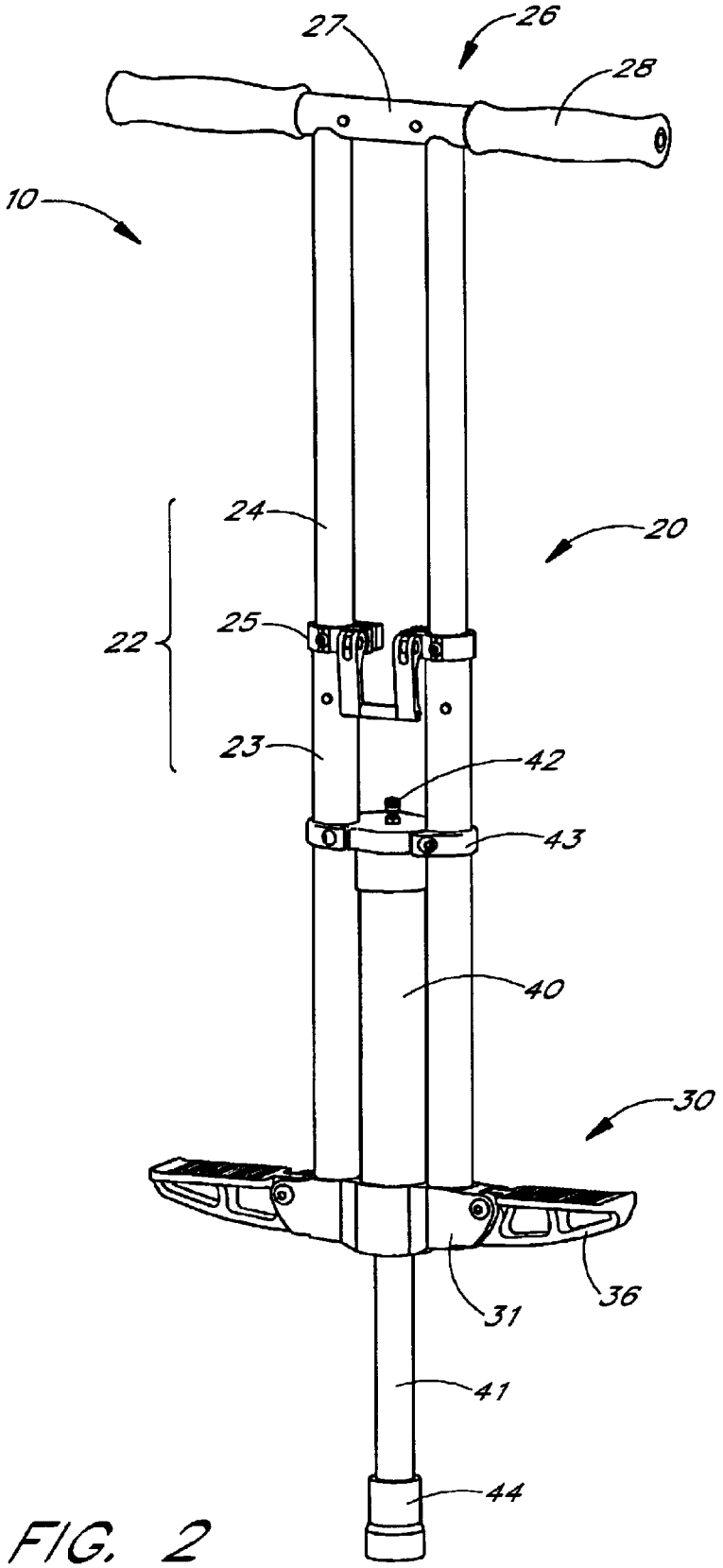
FIG. 2 shows a perspective view of a preferred embodiment of the collapsible pogo stick.

FIG. 5 illustrates the pogo stick 10 described in FIGS. 2–4 wherein the device is collapsed into a small volume. The grips 28 are shown detached from the middle tube 27 subsequent to pushing the retaining projections 281 out of the retaining holes 271 and telescopically sliding the grips 28 out of the ends of the middle tube 27. The handlebar is shown in the collapsed configuration whereby the upper tubes are fully inserted into the lower tubes 23. The positioning device 25 is shown rotated downward in the locked position such that the telescoping handlebar 20 is securely held in the collapsed condition. The two plates 36 are shown pivoted upward in relation to the platform 31 to reduce the width of the footrest 30. In addition, the shaft 41 is shown fully advanced into the cylinder 40 subsequent to discharging the gas from the interior of the cylinder. In the collapsed condition, the pogo stick of the present invention provides for ease of transportation and compact storage. The ability to collapse the pogo stick into a small volume also results in cost savings to the manufacturer because the pogo stick 10 requires less volume during shipping.

Figure 6A:
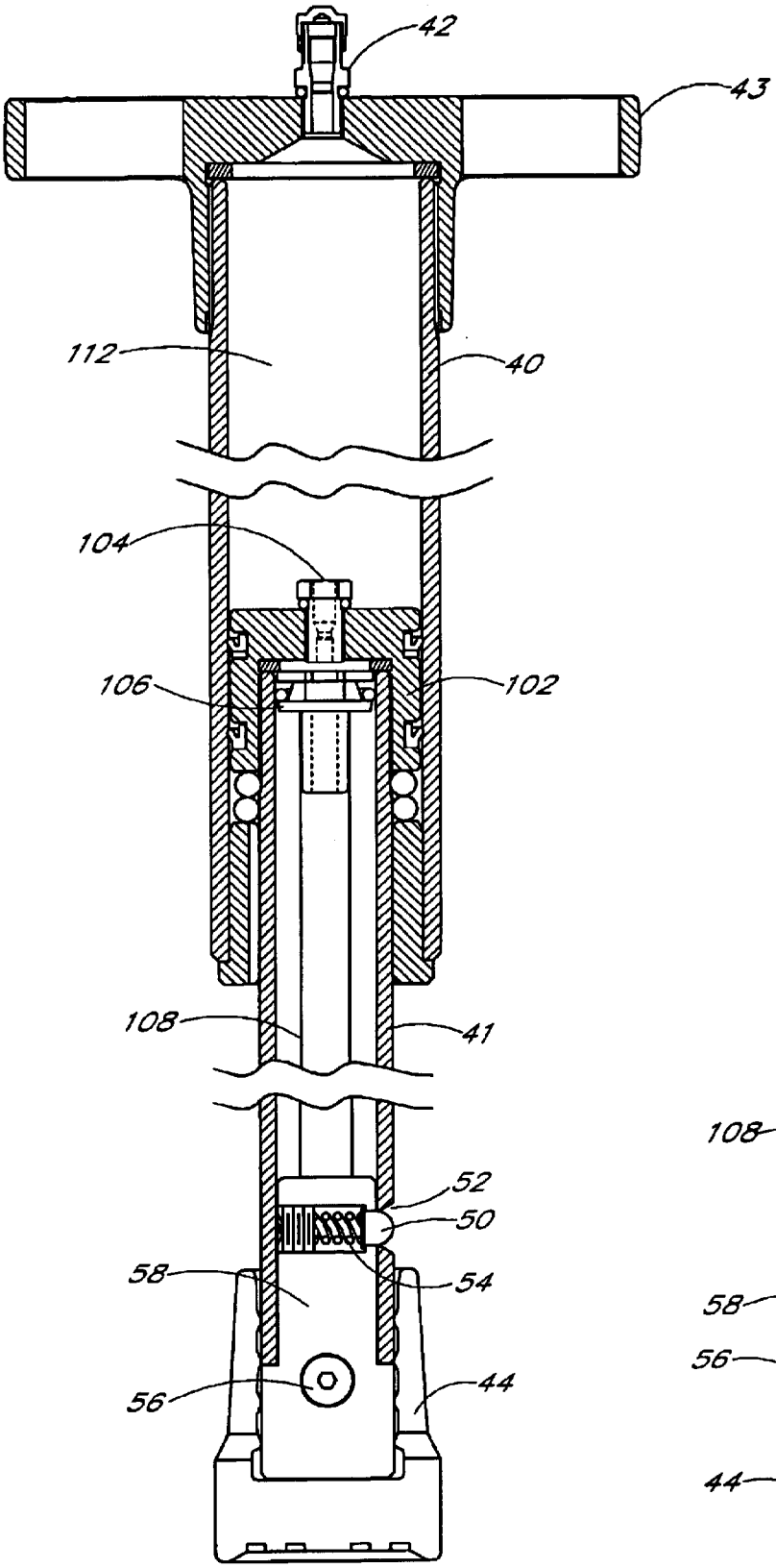
FIG. 6A shows a sectional view of a self-chargeable pneumatic spring wherein a pumping mechanism is contained within the shaft.
Figure 6B:
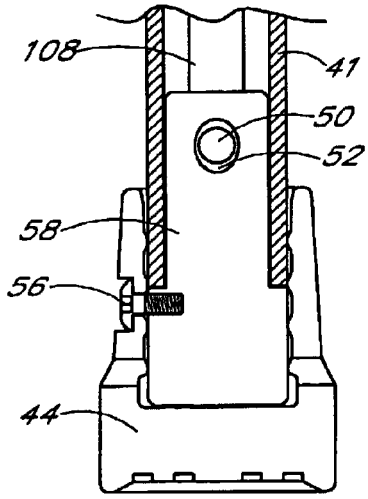
FIG. 6B shows a side view of the buffer sleeve at the base of the shaft.

FIGS. 6A–B illustrate in detail a preferred embodiment of the pneumatic spring used with the collapsible pogo stick. This embodiment of the pneumatic spring comprises the cylinder 40 formed with a hollow cavity and a working piston 102 slidably disposed within the cavity of the cylinder 40. The region between the closed end of the cylinder 40 and the working piston 102 defines a sealed gas chamber 112 containing a gas, such as atmospheric air. The shaft 41 is coupled to the working piston 102 and extends out of the open end of the cylinder 40. The shaft 41 is formed with a hollow interior portion and an open bottom end.

In a novel feature of this pneumatic spring, a manual pump is substantially self-contained within the interior portion of the shaft 41. A pumping piston 106 is slidably disposed within the interior portion of the shaft 41 and a rod 108 is coupled to the pumping piston 106. The rod 108 is extendable out of the shaft 41 via the open end and is provided with a base portion 58 at the free end thereof. When not in use, the rod 108 is fully advanced into the shaft 41 as shown in FIG. 6A. A retaining projection 50 is provided on the base portion 58 and extends through a retaining hole 52 in the shaft 41. The retaining projection 50 is biased outward from the base portion by a coiled spring 54 contained within the base portion 58. A buffer sleeve 44 is fitted over the lower end of the base portion 58 and is attached by a screw 56 that extends through the buffer sleeve 44 into the base portion 58, as shown in FIG. 6B.

The self-charging pneumatic cylinder just described provides a means for increasing the mass of gas in the gas chamber 112. By varying the mass of gas in the gas chamber 112, the spring stiffness can be adjusted to accommodate the body weight and skill level of the user. The gas chamber 112 is charged 41 by depressing the retaining projection 50 to release the rod 108 from the shaft and pulling the buffer sleeve 44 outward from the shaft 41. In this configuration, the rod 108 and pumping piston 106 are free to slide axially within the shaft 41. The buffer sleeve 44 is gripped by the user and is reciprocally actuated such that the pumping piston 106 is advanced and retracted within the shaft 41 to pump gas into the gas chamber 112.

Figure 7:
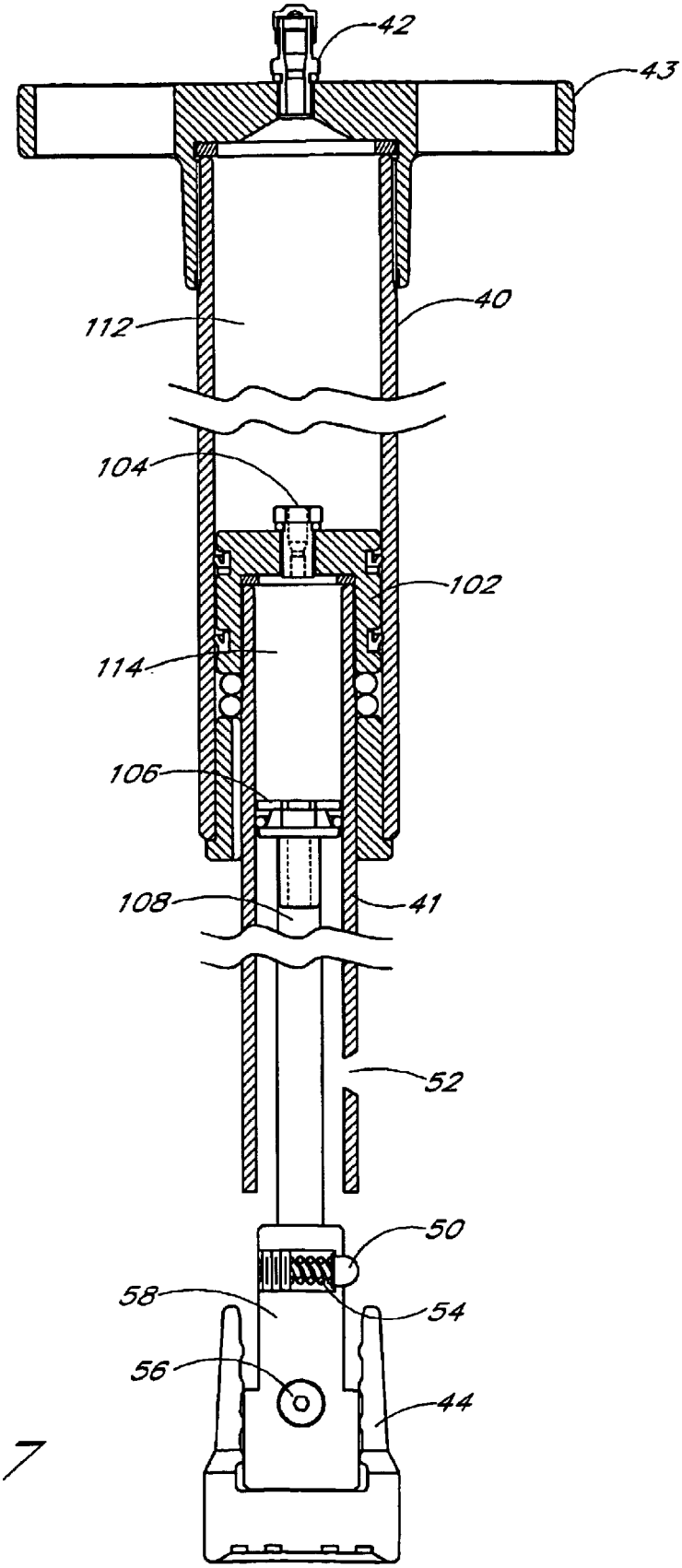
FIG. 7 shows a sectional view of the self-chargeable pneumatic spring of FIG. 6 wherein the pumping mechanism is in use.

FIG. 7 illustrates the self-charging pneumatic cylinder with the pumping piston 106 retracted such that a pressure adding chamber 114 is formed between the bottom of the working piston 102 and the top of the pumping piston 106. When the pumping piston 106 is advanced through the shaft 41, the gas in the pressure adding chamber 114 is compressed. When the gas pressure in the pressure adding chamber 114 exceeds the gas pressure in the gas chamber 112, the gas flows from the pressure adding chamber 114 into the gas chamber 112 via the one-way valve 104 extending through the working piston 102. After the cylinder has been satisfactorily charged by reciprocal actuation of the pumping piston 106, the rod 108 and piston 106 are fully advanced into the working shaft 41 such that the entire self-charging pump mechanism is enclosed within the interior portion of the working shaft 41. The retaining projection 50 is then inserted back into the retaining hole 52 to lock the pump mechanism in place such that the pneumatic spring is prepared for use.

This self-charging pneumatic cylinder is described in further detail in Assignee's U.S. Pat. No. 6,619,634, which is hereby incorporated by reference in its entirety.

Referring again to FIGS. 6–7, the mass of gas in the gas chamber 112 can also be rapidly increased via the two-way valve 42 mounted on top of the cylinder 40. By connecting an external pump to the two-way valve 42, the gas chamber 112 may be charged by using a powered source of air, such as an air pump at a gas station, or by using a manual pump, such as a bicycle pump. The two-way valve 42 also provides a means for rapidly discharging the gas from the cylinder.

The operation and use of the collapsible pogo stick will now be described with reference to the preferred embodiments illustrated in FIGS. 2–7. The pogo stick 10 is prepared for use by first pivoting the plates 36 downward relative to the middle platform 31 to form the footrest 30. Each grip 28 is then telescopically inserted into the middle tube 27 such that the retaining projection 281 is retained by the retaining hole 271. Next, the handlebar 20 is adjusted to the desired height by releasing the positioning device 25 and telescopically sliding the upper tubes 24 upward relative to the lower tubes 23. The positioning device 25 is then clamped back down to lock the handlebar 20 in place. The cylinder 30 is charged by either attaching an external pump to the two-way valve 42 or by manually actuating the pumping piston 106 using the self-charging mechanism described above. Once the pneumatic spring has been adjusted to the appropriate stiffness, the user holds the grips 28 and stands on the footrest 30. The user balances the pogo stick on the free end of the shaft 41 while performing a jumping motion. As the buffer sleeve 44 strikes the ground, the user's kinetic energy forces the shaft 41 into the cylinder 40 thereby compressing the gas located in the gas chamber 112 of the cylinder 40. The compressed gas then resilient recoils to thrust the shaft 41 back outward from the cylinder 40 thereby propelling the user upward into the air. A sealing mechanism is provided in the cylinder to prevent the gas in the gas chamber 112 from discharging during the compression cycle. Because the pneumatic spring uses very few moving parts, the pneumatic spring is lightly damped and the frictional forces relating to the spring are minimized. As a result, the user is provided with a smooth and efficient spring mechanism.

A significant feature of the present invention is the rugged quality of the components and the solid construction of the pogo stick. In the preferred embodiments, the primary components of the pogo stick are manufactured of a metal alloy. In particular, the components are preferably extruded from a lightweight, non-rusting aluminum alloy, such as 6061. Because aluminum is lightweight and the components are generally hollow in construction, the pogo stick has great strength yet is still light enough to be easily transported by the user. Aluminum is resistant to corrosion and therefore the pogo stick can be left outdoors for extended periods without rusting or diminishing in aesthetic value. Furthermore, because of its durable nature, the pogo stick can withstand significant impacts without incurring serious damage.

Figure 8A:
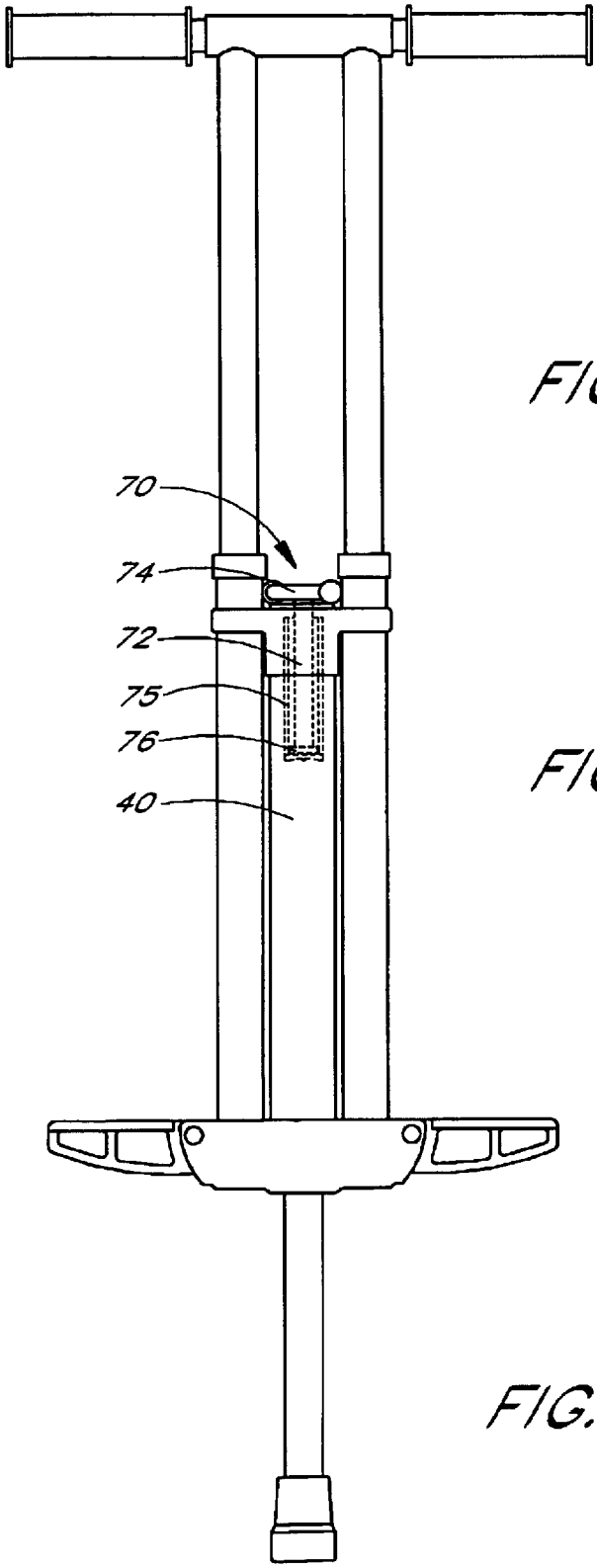
FIG. 8A shows a side view of another preferred embodiment of the collapsible pogo stick wherein a manual pump is provided at the top end of the cylinder for charging the pneumatic spring with a gas.
Figure 8B:
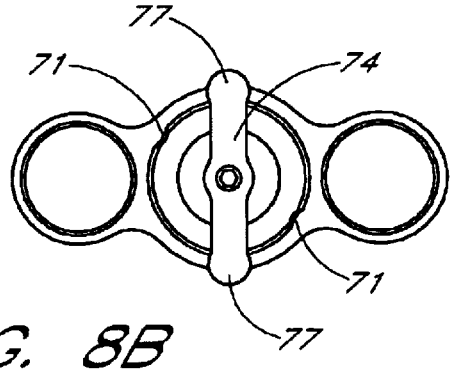
FIG. 8B shows a top view of the manual pump of FIG. 8A with the pump handle in the unlocked position.
Figure 8C:
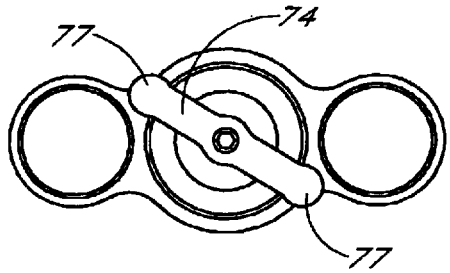
FIG. 8C shows a top view of the manual pump of FIG. 8A with the pump handle in the locked position.
Figure 8D:
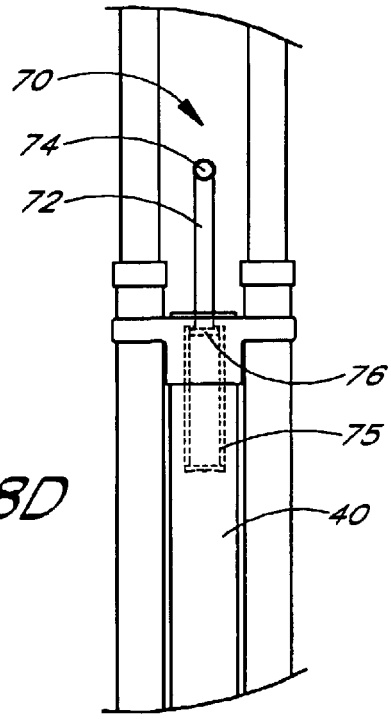
FIG. 8D shows a partial side view of the manual pump of FIG. 8A with the pump handle in use.

FIG. 8A illustrates an alternative embodiment of the self-chargeable pneumatic cylinder wherein a manual pump 70 is mounted on the top end of the cylinder 40. The manual pump 70 comprises a pump rod 72 having a handle 74 formed at the free end thereof. The pump rod 72 is coupled at the bottom end to a piston 76 that slides axially within a pump cylinder 75. A one-way valve (not shown) is located at the bottom end of the pump cylinder 75 which allows pressurized air to flow from the interior of the pump cylinder 75 to the interior of the cylinder 40. FIG. 8B is a top view of the pump illustrating detents 71 formed on the top end of the pump cylinder 75. The detents are adapted for engaging radial enlargements 77 formed on the pump handle 74. The detents help maintain the handle in a locked position when the manual pump is not in use, as shown in FIG. 8C. To operate the manual pump 70, the user grips the pump handle 74 and reciprocally actuates the pump as illustrated by the arrows in FIG. 8D.

Figure 9C:
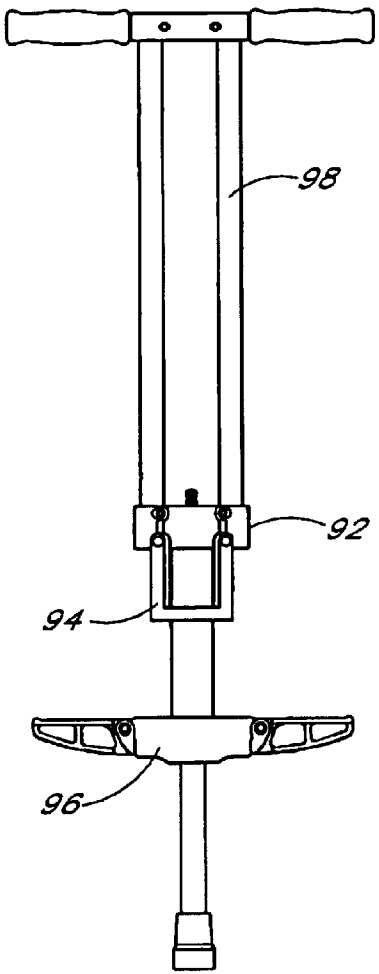
FIG. 9C shows a side view of the embodiment of FIG. 9A wherein the handlebar is in the fully extended position.
Figure 9B:
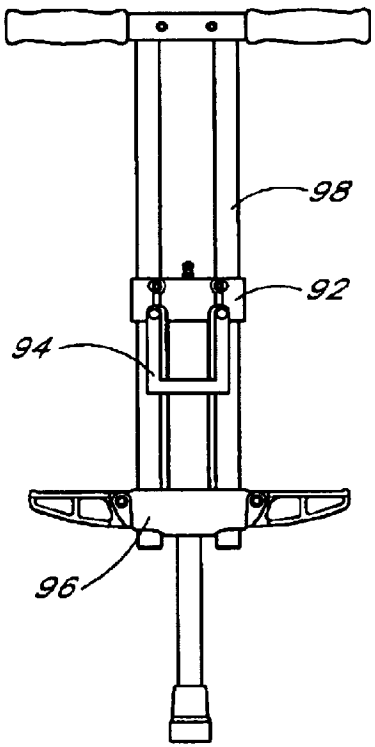
FIG. 9B shows a side view of the embodiment of FIG. 9A wherein the handlebar is in a partially extended position.
Figure 9A:
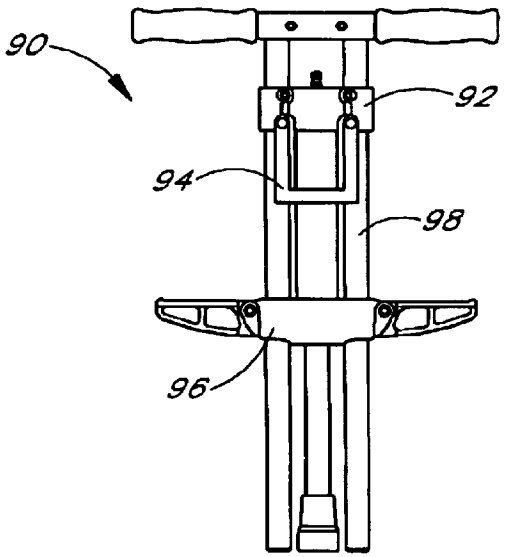
FIG. 9A shows a side view of another preferred embodiment of the collapsible pogo stick wherein the elongate members of the handlebar are slidably engaged within brackets mounted on the cylinder.

FIGS. 9A–C illustrate another preferred embodiment of a collapsible pogo stick 90 according to the present invention wherein the handlebar comprises two parallel elongate members 98 that are slidably engaged within brackets 92 mounted to the top end of the cylinder. A positioning device 94 similar to the positioning device described above with reference to FIG. 3 is provided for fixing the position of the elongate members 98 with respect to the brackets 92. In this embodiment, the middle platform 96 is formed with first and second bores for receiving the elongate members 98 when the handlebar is in the collapsed condition for storage or transportation, as shown in FIG. 9A. FIG. 9B shows the elongate members 98 partially extended. FIG. 9C shows the elongate members 98 in the fully extended position.

Figure 10A:
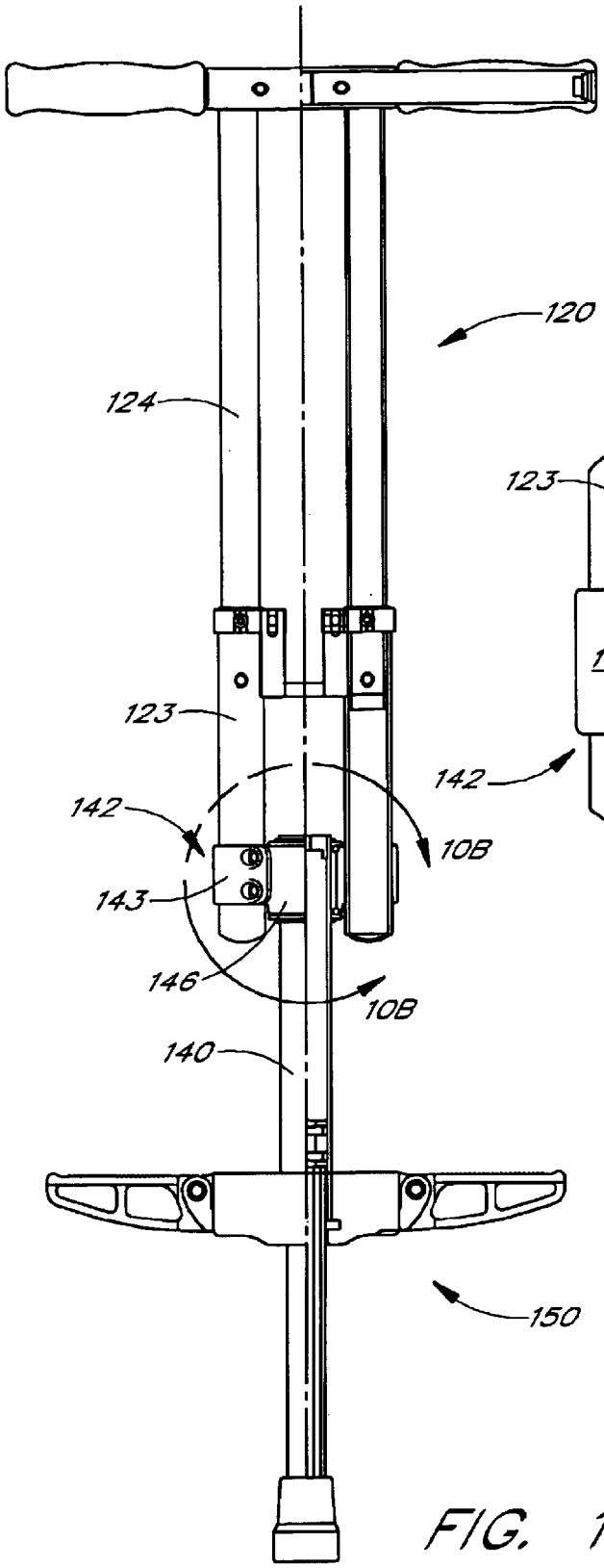
FIG. 10A shows a side view of another preferred embodiment of the collapsible pogo stick wherein the handlebar can be rotated relative to the footrest.
Figure 10B:
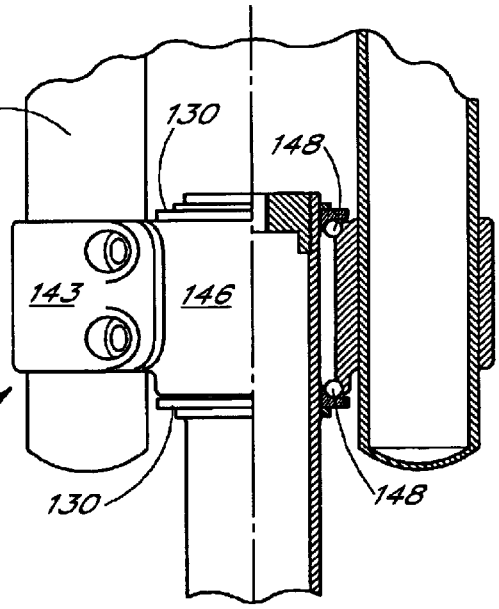
FIG. 10B shows an enlarged partial sectional view of the rotatable bracket illustrated in FIG. 10A.

FIGS. 10A–B illustrate yet another preferred embodiment of a collapsible pogo stick according to the present invention wherein the handlebar 120 is rotatably mounted to the cylinder 140 via a swivel bracket 142. FIG. 10B is an enlarged view illustrating the swivel bracket 142 formed with a tubular center portion 146 having an inner diameter that is slightly larger than the outer diameter of the cylinder 140 such that the swivel bracket 142 is free to rotate around the cylinder 140. The exterior of the cylinder 140 is provided with upper and lower lips 130 for maintaining the swivel bracket 142 in a fixed position along the longitudinal axis of the cylinder 140. A plurality of ball bearings 148 is preferably provided along the inner wall of the tubular center portion 146 for engagement with the exterior of the cylinder 140 and also for engagement with the upper and lower lips 130. The ball bearings 148 reduce the frictional forces produced when the swivel bracket 146 rotates about the cylinder 140. In alternative embodiments, other friction reducing mechanisms may be used instead of ball bearings, such as, for example, brass or bronze bushings. The lower tubes 123 of the handlebar 120 are preferably attached at the lower ends to the swivel bracket 142 by fastening rings 143. This embodiment of the present invention enables the user to perform tricks by swiveling the handlebar portion 120 relative to the footrest 150 while jumping on the pogo stick.

Figure 11A:
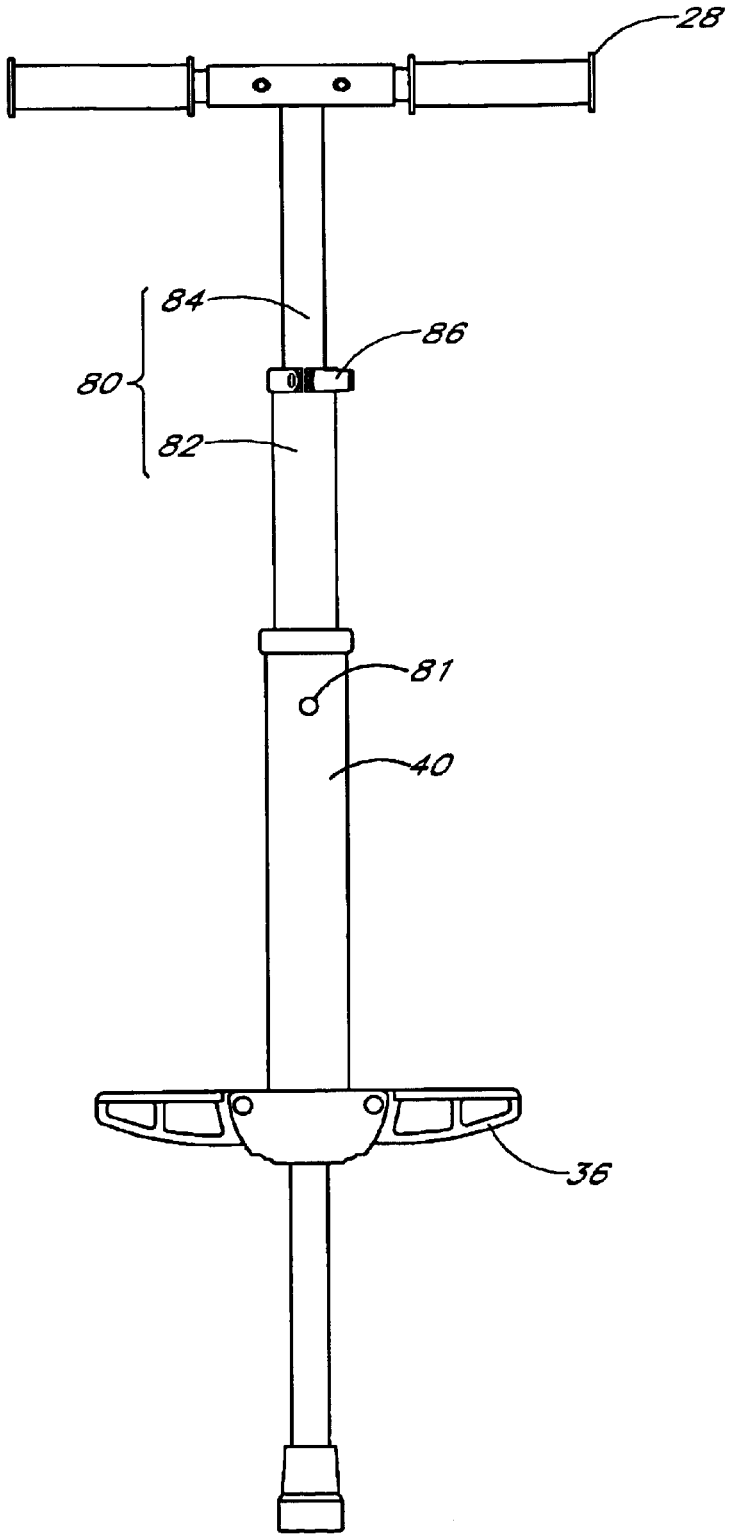
FIG. 11A shows a side view of another preferred embodiment of the collapsible pogo stick having a single telescoping elongate member.

FIG. 11A illustrates yet another preferred embodiment of a collapsible pogo stick according to the present invention wherein the handlebar comprises a single telescoping elongate member 80 having a lower tube 82 and an upper tube 84. The bottom end of the lower tube 82 is mounted to the top end of the cylinder 40 by any suitable means, such as welding or threaded engagement. The mass of gas in the cylinder 40 can be rapidly increased by connecting an external pump to the two-way valve 81 mounted on the cylinder. The upper tube 84 is adjustable relative to the lower tube 82 and can be locked in place with a positioning mechanism 86 of the type described above with respect to FIG. 3.

Figure 11B:
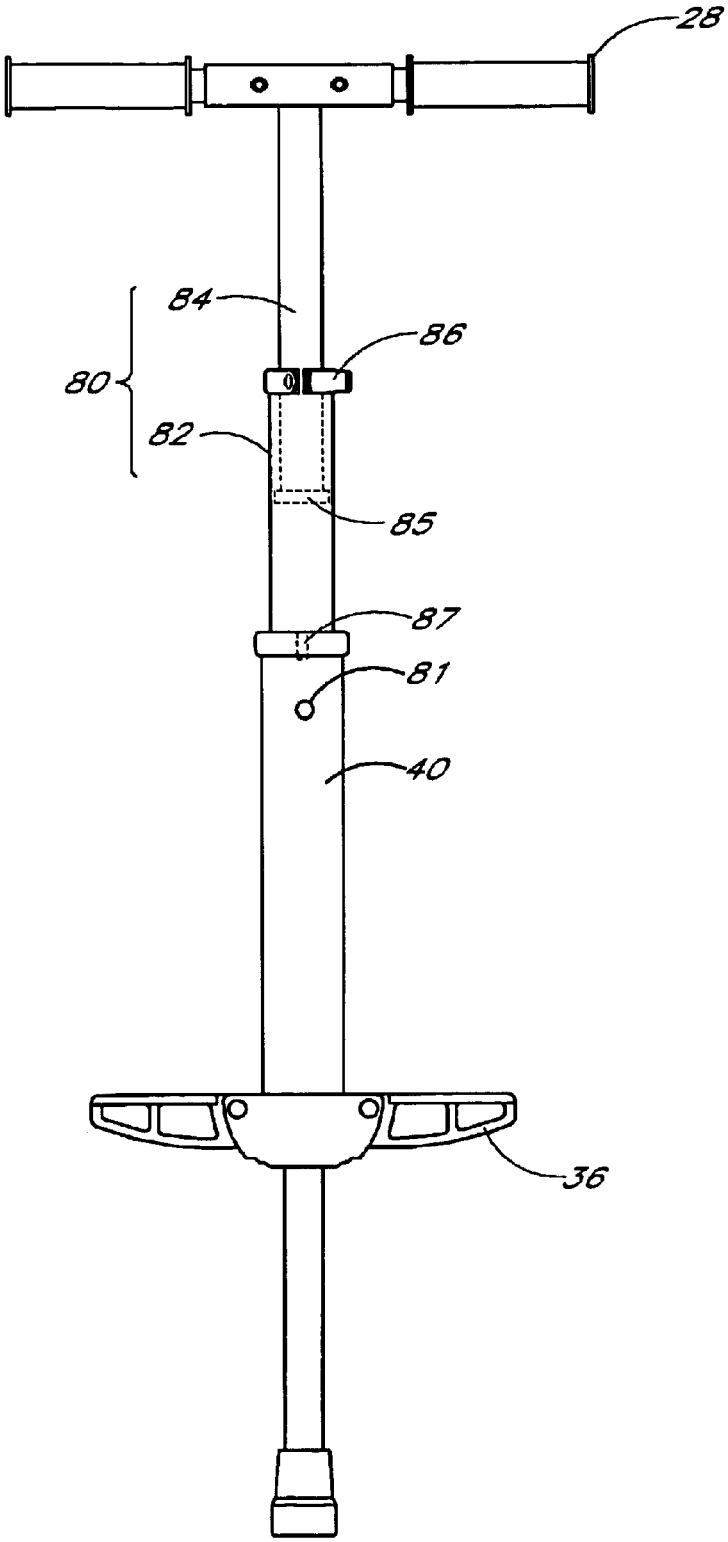
FIG. 11B shows a side view of the collapsible pogo stick of FIG. 11A wherein the single telescoping elongate member also functions as a pumping mechanism for charging the cylinder with a gas.

In a first variation of this embodiment, the cylinder can also be charged with a gas using the self-charging pump mechanism described above with respect to FIGS. 6A–B. In a second variation of this embodiment, shown in FIG. 11B, the telescoping elongate member 80 also functions as a manual pump for charging the cylinder 40 with a gas. In this variation, the lower tube 82 is a pressure cylinder and the upper tube 84 has a piston 85 (shown in dashed) mounted at the lower end thereof. As the upper tube 84 slides into the lower tube 82, the piston 85 forces the gas from the interior of the lower tube 82 into the cylinder 40 across a one-way valve 87 (shown in dashed).

Figure 12:
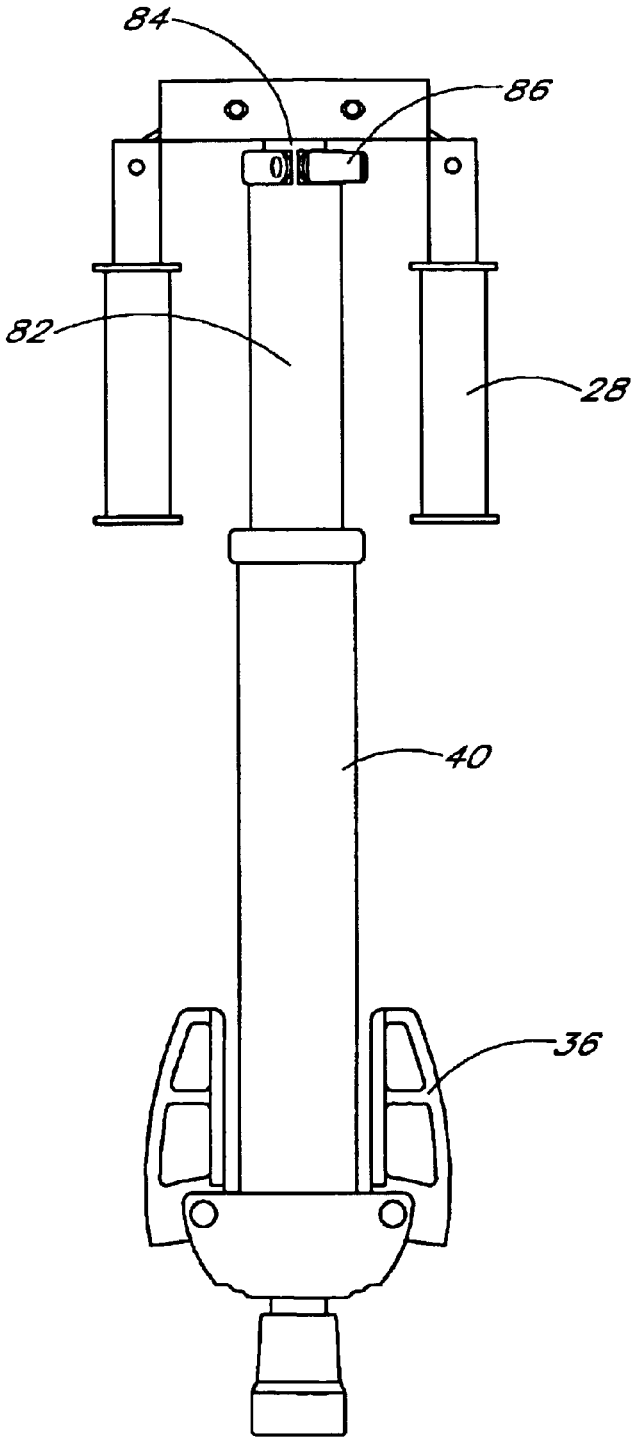
FIG. 12 shows a perspective of the collapsible pogo stick of FIG. 11 in the collapsed state.

FIG. 12 illustrates a collapsible pogo stick with a single elongate member in the collapsed condition whereby the upper tube 84 is fully inserted into the lower tube 82, the grips 28 are removed and the plates 36 are pivoted upward.

Figure 13:
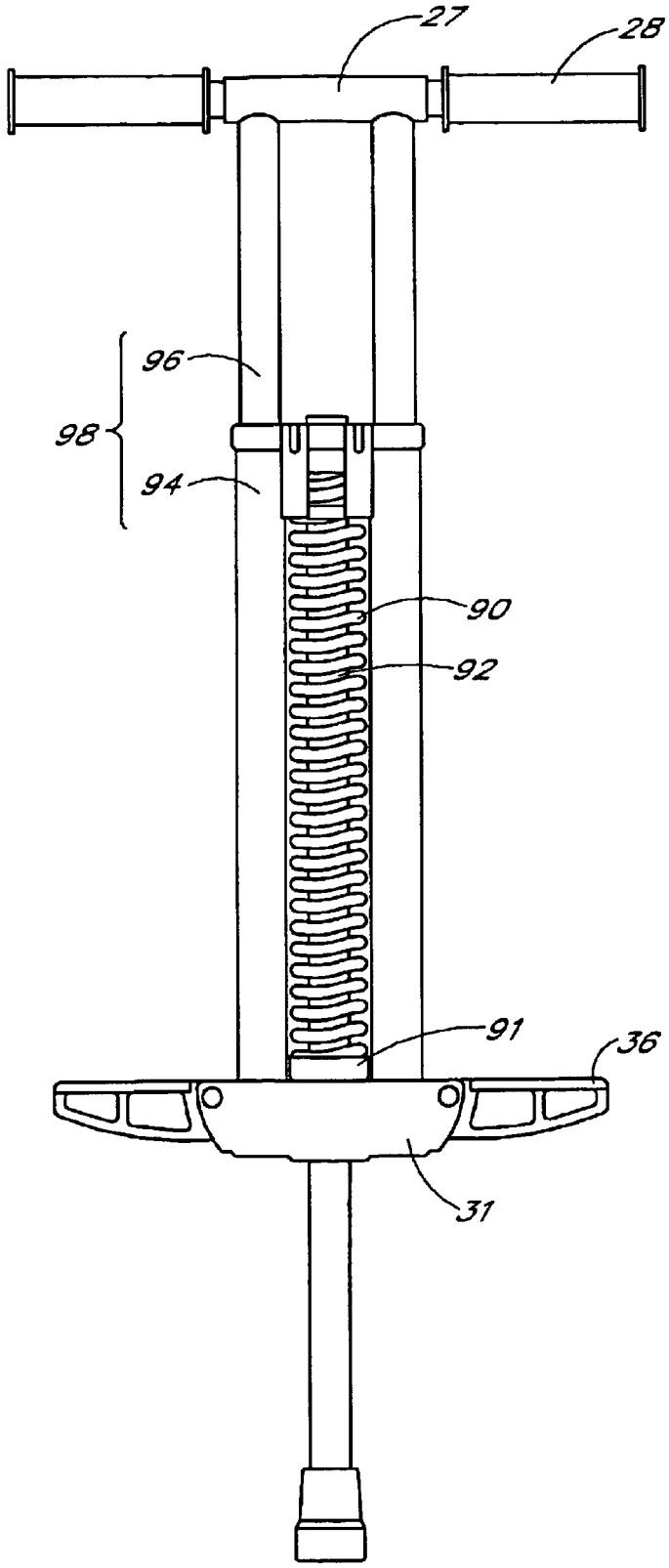
FIG. 13 shows a perspective view of a collapsible pogo stick utilizing a mechanical spring.

FIG. 13 illustrates yet another embodiment of the collapsible pogo stick according to the present invention wherein a coiled mechanical spring is utilized in place of a pneumatic spring. The mechanical spring 90 is placed over the shaft 92 such that the bottom end of the spring is coupled to the shaft 92 by bracket 91 and the top end of the spring is coupled to the lower tubes 94. FIG. 13 illustrates the pogo stick ready for use whereby the upper tubes 96 are extended out of the lower tubes 94, the grips 28 are attached to the middle tube 27 and the plates 36 are pivoted downward relative to the middle platform 31. This embodiment is less expensive to manufacture while still maintaining many of the advantageous collapsible features of the previous embodiments.

While a particular form of the invention has been illustrated and described, it will also be apparent that various additional modifications can be made without departing from the spirit and scope of the invention. For example, the pogo stick may be combined with other features such as a counter mechanism for recording the number of consecutive jumps or a meter to provide feedback regarding the internal gas pressure in the cylinder. Thus, it is intended that the present invention includes all modifications and variations provided they come within the scope of the appended claims and their equivalents.

What is claimed is:

1. A pogo stick that is collapsible for ease of transportation and compact storage while having a rugged construction that ensures high quality and durability and having a pneumatic spring of selectively variable stiffness comprising:

a handlebar including at least one elongate member, said elongate member comprising an upper tube and a lower tube in which one tube telescopes into the other;

first and second collapsible grips supported by said upper tube;

a collapsible footrest supported by said lower tube;

a cylinder supported by said lower tube;

a pneumatic spring piston located within said cylinder;

a tipped bottom shaft coupled at an upper end to said piston, said tipped bottom shalt being substantially collapsible into said cylinder; and a manual pump substantially contained within said tipped bottom shaft.

2. A pogo stick that is collapsible for ease of transportation and compact storage and having a pneumatic spring comprising;

a handlebar including at least one elongate member, said elongate member comprising a lower tube and an upper tube in which one tube telescopes into the other;

first and second collapsible grips supported by said upper tubes;

a collapsible footrest supported by said lower tubes;

a cylinder supported by said lower tubes;

a pneumatic spring piston located within said cylinder; and a shaft an upper end coupled to said pneumatic spring piston, said shaft being subtantially collapsible into the cylinder.

3. A pogo stick that is very durable and is collapsible for ease of transportation and compact storage comprising:

a handlebar including at least one upper tube and one lower tube, said upper tube telescoping with said lower tube;

first and second collapsible grips supported at a top end of said upper tube;

a pneumatic spring including a cylinder defining a cavity therein and a shaft extending from said cylinder, said lower tube being coupled to said cylinder; and a positioning device for releasably holding said upper tube in a fixed position relative to said lower tube;

wherein said pogo stick is collapsible into a small volume by lowering said upper tube into said lower tube and collapsing said grips.

4. The pogo stick of claim 3, further comprising a collapsible footrest mounted at a bottom end of said cylinder.

5. The pogo stick of claim 4 wherein said footrest is provided with a threaded through hole and wherein said cylinder is formed with outer threads for engagement with said threaded through hole.

6. The pogo stick of claim 3 wherein said cylinder is provided at a top end with at least one fastening ring extending therefrom for coupling said lower tube to said cylinder.

7. The pogo stick of claim 3, further comprising a means for adjusting the gas pressure in said cylinder.

8. The pogo stick of claim 3, further comprising a manual pump coupled to said cylinder and in communication with said cavity of said cylinder for adjusting the gas pressure in said cylinder.

9. The pogo stick of claim 3, further comprising a two-way valve coupled to said cylinder for selectively providing communication between said cavity in said cylinder and the atmosphere.

10. A pogo stick that is very durable and is collapsible for ease of transportation and compact storage comprising:

a handlebar including at least one elongate member;

first and second collapsible grips supported at a top end of said elongate member;

a pneumatic spring including a cylinder defining a cavity therein and a shaft extending from said cylinder, said elongate member being slidably coupled to said cylinder;

a positioning device for releasably holding said elongate member in a fixed position relative to said cylinder; and at least one bracket mounted on said cylinder, said elongate member being slidably engaged with said bracket;

whereby said pogo stick can be collapsed into a small volume by lowering said handlebar relative to said cylinder and collapsing said grips.

11. A pogo stick that is very durable and is collapsible for ease of transportation and compact storage comprising:

a handlebar including at least one elongate member;

first and second collapsible grips supported at a top end of said elongate member;

a pneumatic spring including a cylinder defining a cavity therein and a shaft extending from said cylinder, said elongate member being slidably coupled to said cylinder; and a positioning device for releasably holding said elongate member in a fixed position relative to said cylinder;

wherein said pogo stick is collapsible into a small volume by lowering said handlebar relative to said cylinder and collapsing said grips and wherein said shaft is fully advanceable into said cylinder to reduce the volume of said pneumatic spring when not in use.

12. A pogo stick that is very durable and is collapsible for ease of transportation and compact storage comprising:

a handlebar including at least one elongate member, said elongate member comprising a lower tube and an upper tube, said upper tube being telescopically insertable into said lower tube;

a positioning device for releasably clamping said upper tube in a fixed position relative to said lower tube;

a middle tube transversely mounted to said upper tube, said middle tube having first and second ends;

first and second grips detachably fastened to said first and second ends of said middle tube;

a platform transversely mounted to said lower tube, said platform having first and second ends;

first and second plates pivotally mounted to said first and second ends of said platform; and an elastic cord extending lengthwise through said middle tube and attached to said first and second grips for preventing said grips from becoming separated from said middle tube.

13. The pogo stick of claim 12, further comprising a pneumatic spring attached to said lower tube.

* * * * *

UNITED STATES PATENT AND TRADEMARK OFFICE

CERTIFICATE OF CORRECTION

PATENT NO. : 6,827,673 B2
APPLICATION NO. : 09/887553
DATED : December 7, 2004
INVENTOR(S) : Chen et al.

It is certified that error appears in the above-identified patent and that said Letters Patent is hereby corrected as shown below:

In Claim 1, Col. 9, line 43, delete “shalt” and insert -- shaft --, therefor

In Claim 2, Col. 9, line 61, delete “subtantially” and insert -- substantially --, therefor In Claim 2, Col. 9, line 61, after “collapsible into” delete “the” and insert -- said--, therefore Signed and Sealed this Twenty-second Day of August, 2006

JON W. DUDAS
*Director of the United States Patent and Trademark Office*